United States Patent [19]

Lehmann et al.

[11] Patent Number: 4,833,451

[45] Date of Patent: May 23, 1989

[54] INDIVIDUAL SOURCE IDENTIFICATION

[75] Inventors: Reinhold Lehmann, Ladenburg; Hans-Joachim Rusch, Heddesheim, both of Fed. Rep. of Germany

[73] Assignee: Total Walther Feuerschutz GmbH, Cologne, Fed. Rep. of Germany

[21] Appl. No.: 207,103

[22] Filed: Jun. 14, 1988

[30] Foreign Application Priority Data

Jun. 15, 1987 [DE] Fed. Rep. of Germany ..... 3719988

[51] Int. Cl.[4] ..... G08B 25/00; G08B 29/00

[52] U.S. Cl. ..... 340/524; 340/508; 340/509; 340/510; 340/511; 340/512; 340/513; 340/525

[58] Field of Search ..... 340/524, 506, 508–513, 340/525, 52 F, 52 R, 661–663

[56] References Cited

U.S. PATENT DOCUMENTS

| | | | |
|---|---|---|---|
| 4,435,698 | 3/1984 | Klett | 340/512 |
| 4,514,720 | 4/1985 | Oberstein et al. | 340/511 |
| 4,549,168 | 10/1985 | Sieradzki | 340/509 |
| 4,567,471 | 1/1986 | Acar | 340/513 |

*Primary Examiner*—Donnie L. Crosland
*Attorney, Agent, or Firm*—Horst M. Kasper

[57] ABSTRACT

An individual source identification of several signal providers or pick-ups with closable contacts disposed in a twin-wire signal line, in particular for fire detectors in fire alarm systems. The signal pick-up system allows to distinguish actuation of individual sensors separately and apart from a short circuit formation. The fire alarm system also allows connection to automatic sprinkler devices. The fire sensor system is easy to install in that the individual settings of the individual detectors at a construction site are minimized.

20 Claims, 1 Drawing Sheet

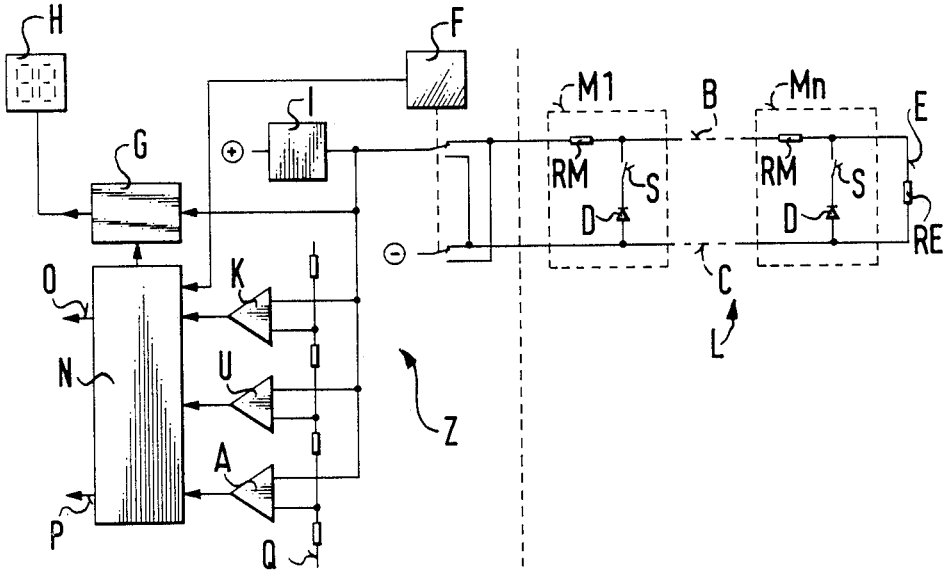
H
F
M1
B
Mn
E
I
G
RM
S
RM
S
D
D
RE
O
K
C
L
N
U
Z
A
P
Q

INDIVIDUAL SOURCE IDENTIFICATION

BACKGROUND OF THE INVENTION

1. Field of the Invention

The invention relates to an individual source identification of several signal providers or pick-ups with closable contacts disposed in a twin-wire signal line, in particular for fire detectors in fire alarm systems.

2. Brief Description of the Background of the Invention Including Prior Art

Signal contacts are employed in many application areas in case of process controls, of measurement and control systems, as well as in case of automatic fire-extinguishing systems, which signal contacts signal the proper function or the position of the final function control members.

If several of such signal contacts are employed in a system, then it is required, in case of a signal deviating from the standard situation, that the place of interference be recognized as soon as possible. This can be performed with an optical display placed at each contact or by a remote transmission of the detector identification.

Optical displays disposed at detectors can be realized in a relatively economic way. However, in large systems where, for example, 100 and more signals are employed, the searching for an optical display of an actuated or responding signal detector is fairly timeconsuming. Other systems lead a line from each signal contact to a central location. A quick identification is thereby possible. However, the expenditure of installing such a system is substantial.

As a consequence of this measure, each detector comprises only one contact and two inexpensive passive device elements. Several such detectors can be disposed in an unprotected twin-wire signal line. In this case, each released detector has the value "1", where this value is increased depending on the sequence of the detectors disposed in the signal line, respectively, by the number of the detectors disposed in the course of the signal line ahead of the actuated or responding detector. This means that in each signal line with, for example, ten detectors, in case of an actuation the detector disposed at the sixth position sends a message with the value six to the central station. The same situation occurs with the remaining detectors. The evaluation circuit can display the value digitally or analog or can, with a corresponding program, be furnished as an alphanumeric output.

A later increase or decrease of the number of detectors is possible without interfering in the detectors or in the evaluation device.

SUMMARY OF THE INVENTION

1. Purposes of the Invention

It is an object of the invention to provide a signal pick-up system allowing to distinguish actuation of individual sensors separately and apart from a short circuit formation.

It is another object of the invention to provide a fire alarm system which allows connection to automatic sprinkler devices.

It is yet a further object of the invention to provide a fire sensor system with an easy installation procedure, where individual settings of individual detectors at a construction site are minimized.

These and other objects and advantages of the present invention will become evident from the description which follows.

2. Brief Description of the Invention

The present invention provides for an individual source identification system. The system comprises a twin-wire signal detection line having a first and second terminal on one end a third and fourth terminal on a second end. Signal pick-up detectors with closable contacts are disposed in and connected to the twin-wire signal detection line including a diode and a closable contact in series connection. A terminating signal resistance connects the third and the fourth terminal. A pole inverter switch is connected to a current source and to the first and second terminals of the twin-wire signal detection line for feeding electric power to the twin-wire detection line. The pole switch inverts the line voltage in the twin-wire signal line. A comparator chain with comparators matches the signal pick-up detectors. An evaluation circuit is connected to the comparator chain. A voltage measurement circuit is connected to the first terminal and to the evaluation circuit for comparing the voltage at the first terminal with a reference voltage. A signal display is connected to the voltage measurement circuit. An interference line is connected to the evaluation circuit. An alarm signal line is connected to the evaluation circuit.

Fire alarm systems can be connected to the alarm signal line. The signal pick-up detectors can be fire detectors.

The pole inverter switch can aperiodically or periodically invert the line voltage in the twin-wire signal line.

Preferably, the evaluation circuit, in case of an actuation of a signal pick-up detector, feeds the actuation value to the signal display in digital or analog values. With a corresponding program, the evaluation circuit can furnish the actuation value alphanumerically.

The value of the terminating resistance can be larger than the sum of all signal resistances.

The evaluator can discriminate between short circuit, resistive circuit and open circuit and, upon such finding, can pass a signal to the interference signal line, and closed switch, upon such finding, can pass a signal to the alarm signal line.

A method of individual source identification comprises placing a twin-wire signal detection line having a first and second terminal on one end and a third and fourth terminal on a second end into a detection area with signal pick-up detectors with closable contacts disposed in and connected to the twin-wire signal detection line including a diode and a closable contact in series connection. A terminating signal resistance is connected to the third and the fourth terminal. A pole inverter switch is connected to a current source and to the first and second terminals of the twin-wire signal detection line. Electric power is fed to the twin-wire detection line. The line voltage in the twin-wire signal line is inverted with the pole switch. A signal generated by the twin wire signal line in a comparator chain is compared with comparators matching the signal pick-up detectors. A voltage is measured with a voltage measurement circuit connected to the first terminal and to the evaluation circuit for comparing the voltage at the first terminal with a reference voltage. The comparison value is fed to an evaluation circuit connected to the comparator chain. The values obtained in the voltage measurement circuit are fed to a signal display connected to the voltage measurement circuit. A signal is sent from the evaluation circuit to an interference line connected to the evaluation circuit in case a short circuit occurs in the twin-wire line. An alarm signal is sent from the evaluation circuit to an alarm signal line connected to the evaluation circuit.

The evaluator can discriminate between short circuit, resistive and open circuit. A signal can be passed to the interference signal line upon finding of a short circuit. A signal can be passed to the alarm signal line upon finding a resistive circuit. A fire alarm system connected to the alarm signal line can be actuated upon feeding a fire alarm signal from the evaluation circuit to the alarm signal line.

The line voltage can be aperiodically or periodically inverted with the pole inverter switch in the twin-wire signal line.

The actuation value can be fed from the evaluation circuit to the signal display in digital or analog values in case of an actuation of a signal pick-up detector. The actuation value can be fed alphanumerically with a corresponding program from the evaluation circuit.

The invention provides a simple and economic solution for the individual display which is capable to distinguish, according to governmental and security requirements, between an interference and disruption of the line due to a short circuit or an interruption and a message, for example a danger signal.

After the actuating or response of the evaluation device, a test cycle is initially run. In case of a short circuit of the signal line, the same resistance value is measured during the inversion of the line voltage as before the inversion. This results in an interference, fire or failure location indication.

If during the inversion of the line voltage the value of the terminating resistance is measured, then the preceding value was a closed signal contact. This results in a corresponding output signal and the measured resistance value is displayed as a signal location and given as a numeral.

The cost of the additionally incorporated two device elements in the detectors amounts only to a fraction of the price of the complete detector. The installation is very simple and safe against interference. Each signal location can be distinguished and pinpointed immediately upon appearing of the detector signal, for example, by way of a location plan or site plan provided with numerals.

Such a system is eminently suitable for surveillance of slider positions, as they are required for sprinkler systems. In addition, extinguishing systems, where dwindling and exhaustion of extinguishing material detectors for the extinguishing means are required, can thus be realized with substantial cost savings.

In contrast to known systems, where a complex electronic device block has to be installed in each detector, the invention is associated with the additional advantage that no individual settings of the individual detectors have to be performed at the construction site. An insertion module can be employed for a display in the firesignal center, which contains also a digital display in addition to the usual displays for system failure and line failure. The digital display indicates the number of the actuating or responding signal contacts upon disturbance of the system. Each insertion module can survey several detectors. The usual twin-wire line is sufficient for the connection between the central station and the detectors.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention:

FIG. 1 is a schematic view of a system suitable for individual indication:

DESCRIPTION OF INVENTION AND PREFERRED EMBODIMENT

In accordance with the present invention, there is provided an individual source identification of several signal pick-ups with closable contacts disposed in a twin-wire signal detection line, in particular for fire detectors with fire alarm systems. A diode D is coordinated in the detectors M to each closable contact S. One of the wires B comprises respectively a signal resistance RM, where the wires BC of the signal line L are terminated with a line E with a terminating resistance RE. The line voltage is periodically or aperiodically inverted in the fed signal line L via a constant current generator I with an inverter F, where the voltage of a voltage measurement circuit G, with a signal display H, and where an evaluation circuit N with an interference line O and with an alarm signal line P, are fed via a comparator chain Q with comparators K, U, A.

The evaluation circuit N, in case of an actuation of a detector M, can feed the actuation value to the signal display H in digital or analog values. The evaluation circuit N can furnish the actuation value alphanumerically with a corresponding program.

The value of the terminating resistance RE can be larger than the sum of all signal resistances RM.

The invention provides a fire-alarm system which, on the one hand, comprises a signal line L and, on the other hand, a fire-report system Z.

The signal line L with the wires BC is terminated by the terminating line E with the terminating resistance RE. A current flows through the signal line L, which current is determined by the constant current generator I. A voltage is thereby applied at the input terminals of the signal line L. The value of the voltage depends on the addition of all signal resistances RM and on the terminating resistance RE. This voltage is fed to the voltage measurement circuit G and via a comparator chain Q with the comparators K, U, A to an evaluation circuit N.

If now one of the detectors 1 to n disposed in the course of the signal line L is now actuated or responds, then the incorporated detector contact S closes. Thereby the number of the in-series-connected signal resistances RM is changed and thus also the total resistance of the signal line L through which a constant current flows. Thus, the line voltage applied at the input terminals of the signal line L is inevitably changed. The evaluation N is controlled via the comparator A of the comparator chain Q such that an alarm signal is fed via P. At the same time, the voltage measurement G and the signal display H become actuated. A numeral appears in the display H. This numeral depends on the measured voltage. Since the voltage measured in turn is dependent on the number of the resistances RM connected in series in the signal line L at the point in time of alarm, this numeral can serve as an identification of the responding detector M. Advantageously, the transformation of the measured voltage into the display numeral is constructed such that a display numeral "1"has the same meaning as the first detector M disposed in the signal line L, a display numeral "2"refers to the second detector. It is thereby assured that all detectors M have identical signal resistances RM and that no adaptation after installation or after expansion of a signal line becomes necessary. The alarm signal fed via P can for example open an alarm valve of a sprinkler plant and can thus start the extinguishing process via the sprinkler plant in case of a fire.

In order to allow a distinction between a closed signal contact and a short circuit in the signal line L, for example between two detectors, a diode D is connected in series to each signal contact. The feeding of the signal line L is periodically inverted in its polarity by an inverter I. The inversion can occur at a rate of from about 1 cycle per minute to 200 cycles per minute. A direct current voltage is generally present in the normal operation of the signal line L at the comparator chain Q, which is interrupted only by the switching cycle time of a pole commutator or change-over reversing switch operated by the inverter F. The value of this voltage is determined substantially by the resistance RE, the value of which is larger than the sum of all resistances RM possible in a signal line. In case of an interruption of the line, no current flows via this terminating resistance RE. An interference signal is supplied via O, via the comparator U of the comparator chain Q and the evaluation N. In case of a short circuit of the signal line L, the line voltage will sink based on the then bridged resistance RE and possibly a part of the resistances RM. This results in an actuation of the comparator K of the comparator chain Q and in the placing of an interference message.

Nearly the same situation occurs upon the actuation or response of a detector M as that in case of a short circuit. However, the line voltage is lowered only during a half-period of the inverter F. During the following half-period, the state of the signal line is the same as in normal operation, since the diode D, connected in series to the detector M, is conducting only in one direction and thus only during one half-period of the closed contact S, which thereby bridges a part of the detector M and the terminating resistance RE.

The thus periodically alternating line voltage results in an actuation or response of the comparator A of the comparator chain Q and frees, via the evaluation circuit N, the voltage measurement G with successive signal display in H. Thus, it is assured that a short circuit of the signal line L, as required in the defined regulations, does not lead to an alarm message and thus triggers an alarm. In addition, only two passive device elements are required in the detectors which are of identical construction. These two passive device elements signal the required individual display of the actuated detector provider. In addition, no adaptation of the central station Z or a manipulation of the detectors M is required if there is later performed a change of the number of the detectors M in the signal line L.

The comparator circuit can be laid out such that each stage of the comparator circuit corresponds to a different signal contact. The comparator circuit can employ a sequence of resistors, which are substantially proportional to the resistors RM of the twin-wire line. The resistance of the resistances $R_M$ can be from about 10 to 200 times that of the detector resistance and is, preferably, from about 50 to 100 times the resistance of a single detector resistance. The comparator circuits can be constructed such that they differentiate unequivocally the number of detection resistors placed in the line.

It will be understood that each of the elements described above, or two or more together, may also find a useful application in other types of individual source identification systems differing from the types described above.

While the invention has been illustrated and described as embodied in the context of an individual source identification system for fire-alarm systems, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An individual source identification system comprising a twin-wire signal detection line having a first and second terminal on one end and a third and fourth terminal on a second end;

signal pick-up detectors with closable contacts disposed in and connected to the twin-wire signal detection line including a diode and a closable contact in series connection;

a terminating signal resistance connecting the third and the fourth terminal;

a current source;

a pole inverter switch connected to the current source and to the first and second terminals of the twin-wire signal detection line for feeding electric power to the twin-wire detection line and wherein the pole switch inverts the line voltage in the twin-wire signal line;

a comparator chain with comparators matching the signal pick-up detectors;

an evaluation circuit connected to the comparator chain;

a voltage measurement circuit connected to the first terminal and to the evaluation circuit for comparing the voltage at the first terminal with a reference voltage;

a signal display connected to the voltage measurement circuit; an interference line connected to the evaluation circuit; an alarm signal line connected to the evaluation circuit.

2. The individual source identification system according to claim 1 further comprising fire alarm systems connected to the alarm signal line.

3. The individual source identification system according to claim 1 wherein the signal pick-up detectors are fire detectors.

4. The individual source identification system according to claim 1 wherein the pole inverter switch aperiodically inverts the line voltage in the twin-wire signal line.

5. The individual source identification system according to claim 1 wherein the pole inverter switch periodically inverts the line voltage in the twin-wire signal line.

6. The individual source identification system according to claim 1 wherein the evaluation circuit, in case of an actuation of a signal pick-up detector, feeds the actuation value to the signal display in digital values.

7. The individual source identification system according to claim 1 wherein the evaluation circuit, in case of an actuation of a signal pick-up detector, feeds the actuation value to the signal display in analog values.

8. The individual source identification system according to claim 1 wherein the evaluation circuit furnishes the actuation value alphanumerically with a corresponding program.

9. The individual source identification system according to claim 1 wherein the value of the terminating resistance is larger than the sum of all signal resistances.

10. The individual source identification system according to claim 1 wherein the evaluator discriminates between short circuit, resistive circuit and open circuit and, upon such finding, passes a signal to the interference signal line, and closed switch, upon such finding, passes a signal to the alarm signal line.

11. Individual identification of several signal pick-ups with closable contacts disposed in a twin-wire signal detection line, in particular for fire detectors with fire alarm systems, wherein a diode (D) is coordinated in the detectors (M) to each closable contact (S) and wherein one of the wires (B) comprises respectively a signal resistance (RM), where the wires (BC) of the signal line (L) are terminated with a line (E) with a terminating resistance (RE), and wherein the line voltage is periodically or aperiodically inverted in the fed signal line (L) via a constant current generator (I) with an inverter (F), where the voltage of a voltage measurement circuit (G) with a signal display (H) and where an evaluation circuit (N) with an interference line (O) and with an alarm signal line (P) are fed via a comparator chain (Q) with comparators (KUA).

12. Individual identification according to claim 11, wherein the evaluation circuit (N), in case of an actuation of a detector (M), feeds the actuation value to the signal display (H) in digital or analog values.

13. Individual identification according to claim 11, wherein the evaluation circuit (N) furnishes the actuation value alphanumerically with a corresponding program.

14. Individual identification according to claim 11, wherein the value of the terminating resistance (RE) is larger than the sum of all signal resistances (RM).

15. A method of individual source identification comprising placing a twin-wire signal detection line having a first and second terminal on one end and a third and fourth terminal on a second end into a detection area with signal pick-up detectors with closable contacts disposed in and connected to the twin-wire signal detection line including a diode and a closable contact in series connection;

connecting a terminating signal resistance to the third and the fourth terminal;

connecting a pole inverter switch to a current source and to the first and second terminals of the twin-wire signal detection line;

feeding electric power to the twin-wire detection line; inverting the line voltage in the twin-wire signal line with the pole switch;

comparing a signal generated by the twin-wire signal line in a comparator chain with comparators matching the signal pick-up detectors;

measuring a voltage with a voltage measurement circuit connected to the first terminal and to the evaluation circuit for comparing the voltage at the first terminal with a reference voltage;

feeding the comparison value to an evaluation circuit connected to the comparator chain;

feeding values obtained in the voltage measurement circuit to a signal display connected to the voltage measurement circuit;

sending a signal from the evaluation circuit to an interference line connected to the evaluation circuit in case a short circuit occurs in the twin-wire line;

sending an alarm signal from the evaluation circuit to an alarm signal line connected to the evaluation circuit.

16. The method of individual source identification according to claim 15 comprising discriminating in the evaluator between short circuit, resistive and open circuit;

passing a signal to the interference signal line upon finding of a short circuit;

passing a signal to the alarm signal line upon finding a resistive circuit;

actuating a fire alarm system connected to the alarm signal line upon feeding a fire alarm signal from the evaluation circuit to the alarm signal line.

17. The method of individual source identification according to claim 15 comprising aperiodically inverting the line voltage with the pole inverter switch in the twin-wire signal line.

18. The method of individual source identification according to claim 15 further comprising periodically inverting the line voltage with the pole inverter switch in the twin-wire signal line.

19. The method of individual source identification according to claim 15 further comprising feeding the actuation value from the evaluation circuit to the signal display in digital values in case of an actuation of a signal pick-up detector; and feeding the actuation value alphanumerically with a corresponding program from the evaluation circuit.

20. The method of individual source identification according to claim 15 further comprising feeding the actuation value from the evaluation circuit to the signal display in analog values in case of an actuation of a signal pick-up detector.

* * * * *